United States Patent [19]

Maruyama et al.

[11] Patent Number: 4,722,443

[45] Date of Patent: Feb. 2, 1988

[54] PAPER SHEET PROCESSING APPARATUS

[75] Inventors: Nobusato Maruyama, Tokyo; Takeshi Kohno, Yokohama; Kazuhito Haruki, Kawasaki; Kozo Matsumoto; Toshiyuki Miyano, both of Yokohama, all of Japan

[73] Assignee: Tokyo Shibaura Denki Kabushiki Kaisha, Kawasaki, Japan

[21] Appl. No.: 858,852

[22] Filed: Apr. 30, 1986

Related U.S. Application Data

[63] Continuation of Ser. No. 541,003, Oct. 11, 1983, abandoned.

[30] Foreign Application Priority Data

Oct. 14, 1982 [JP] Japan ..... 57-180229

[51] Int. Cl.[4] ..... B07C 5/34

[52] U.S. Cl. ..... 209/534; 29/33.52; 29/426.3; 29/564.3; 83/909

[58] Field of Search ..... 209/534, 583, 546, 551; 53/587, 54; 29/33.52, 426.3, 564.3; 83/909

[56] References Cited

U.S. PATENT DOCUMENTS

| | | | |
|---|---|---|---|
| 4,025,420 | 5/1977 | Horino | 209/534 |
| 4,236,639 | 12/1980 | Boettge et al. | 209/534 |
| 4,376,364 | 3/1983 | Horino et al. | 53/587 X |
| 4,402,410 | 9/1983 | Ohba et al. | 209/534 |
| 4,413,738 | 11/1983 | Pemberton et al. | 209/583 X |
| 4,414,730 | 11/1983 | Ohmura et al. | 209/534 X |
| 4,586,232 | 5/1986 | Ohmura et al. | 209/534 X |
| 4,660,818 | 4/1987 | Conner et al. | 209/534 X |

FOREIGN PATENT DOCUMENTS

| | | | |
|---|---|---|---|
| 0090348 | 10/1983 | European Pat. Off. . | |
| 3115001 | 3/1982 | Fed. Rep. of Germany . | |
| 3144820 | 11/1982 | Fed. Rep. of Germany . | |
| 54-111893 | 1/1979 | Japan | 209/534 |
| 55-158531 | 12/1980 | Japan . | |
| 57-153546 | 9/1982 | Japan . | |
| 2076355 | 12/1981 | United Kingdom . | |
| 2092355 | 8/1982 | United Kingdom . | |

OTHER PUBLICATIONS

"*Toshiba Currency Note Arranger*", Toshiba Review, No. 130, Nov.-Dec. 1980.

*Primary Examiner*—Robert B. Reeves
*Assistant Examiner*—Edward M. Wacyra
*Attorney, Agent, or Firm*—Cushman, Darby & Cushman

[57] ABSTRACT

An apparatus for processing paper sheets comprises a batch feeder for carrying the withdrawn paper sheets, a takeout device for picking up the paper sheets from the batch feeder, one by one, an inspection section for inspecting the paper sheets picked up by the takeout device, whereby the paper sheets are classified into two groups, an unmachinable first group and a machinable second group, a first collecting device for collecting the first group of paper sheets, and a judgment unit for classifying the second group of paper sheets into two subgroups, a legitimate third group and a counterfeit fourth group. The first collecting device includes a second collecting device for collecting the third group of paper sheets, and third collecting device for collecting the fourth group of paper sheets.

13 Claims, 31 Drawing Figures

7B
7A1
M5
M4
M3
M2
M1
9
14
11
10
10A
10B
10C
10D
7B1
1
2
2A
2B
2C
2D
3
3A
3B
3C
3D
3E
4
5A
5B
5C
5D
5E
6
6A
6B
6C
6D
7A
7A1
8
8A
8B
8C
BIN1
BIN2
BIN3
BIN4
BIN5
BIN6
FW1
FW2
FW3
FW4
FW5
GT

PAPER SHEET PROCESSING APPARATUS

This is a continuation of application Ser. No. 541,003, filed Oct. 11, 1983, which was abandoned upon the filing hereof.

CROSS REFERENCE TO RELATED APPLICATIONS

This application is related to, and contains a substantially identical disclosure to, co-pending applications Nos. 541,005 to Ohmura, filed Oct. 11, 1983, and 541,002 to Ohmura, filed Oct. 11, 1983.

BACKGROUND OF THE INVENTION

The present invention relates to a paper sheet processing apparatus into which paper sheets are fed and from which they are taken out, one by one, for predetermined processing.

As an example of the paper sheet processing apparatus of this type, a bank note processing apparatus is conventionally known in which a batch of, e.g., 100 bank notes, half-wrapped with a paper band, are untied and taken out one by one for judgment, and are sorted and collected on the basis of the results of judgment.

The bank notes to be taken out individually may include some notes that cannot be identified due to superposition, skew, etc. (unmachinable notes). The apparatus is therefore provided with an inspection section for inspecting the bank notes before the judgment, so that the unmachinable notes are brought together in an unmachinable note collecting section. Those machinable notes which are judged counterfeit are also collected in the unmachinable note collectihg section. Thus, the unmachinable notes and counterfeit notes are processed as rejectable or rejected notes. In the prior art bank note processing apparatus however, the rejected notes are collected without regard to the cause of rejection, thus requiring troublesome post-processing, such as manual judgment.

SUMMARY OF THE INVENTION

The present invention is contrived in consideration of the aforementioned circumstances, and is intended to provide a paper sheet processing apparatus capable of sorting rejected notes by the cause of rejection to allow for smooth post-processing.

In order to attain the above object, an apparatus according to the present invention is provided with rejected sheet sorting/collecting means for sorting and collecting paper sheets judged rejectable in relation to the cause of rejection.

According to one aspect of the present invention, there is provided an apparatus for processing paper sheets for general use which are withdrawn as required and are classified into two categories, those fit for reuse and those unfit for reuse, comprising carry means for carrying the withdrawn paper sheets, pickup means for picking up the paper sheets from the carry means, one by one, inspection means for inspecting the paper sheets picked up by the pickup means, whereby the paper sheets are classified into two groups, an unmachinable first group and a machinable second group, first collecting means for collecting the first group of paper sheets, judgment means for classifying the second group of paper sheets into two subgroups, a legitimate third group and a counterfeit fourth group, second collecting means for collecting the third group of paper sheets, and third collecting means for collecting the fourth group of paper sheets.

According to another aspect in the invention, sheets are classified into two categories, those fit for reuse and those unfit for reuse. Batches of the paper sheets are sealed with a wrapping band, and structure is provided for removing this wrapping band. The paper sheets are picked up one by one and classified. The counterfeit paper sheets are stored in a collecting means. A storing means includes a group of classification cards which have respective identification numbers prestored thereon. These classification cards are supplied one by one to the collecting means.

DETAILED DESCRIPTION OF THE PREFERRED EMBODIMENT

There will now be described in detail a bank note processing apparatus as one embodiment of the paper sheet processing apparatus according to the present invention, which processes bank rotes as paper sheets.

Figures 1A, 1B, 1C:
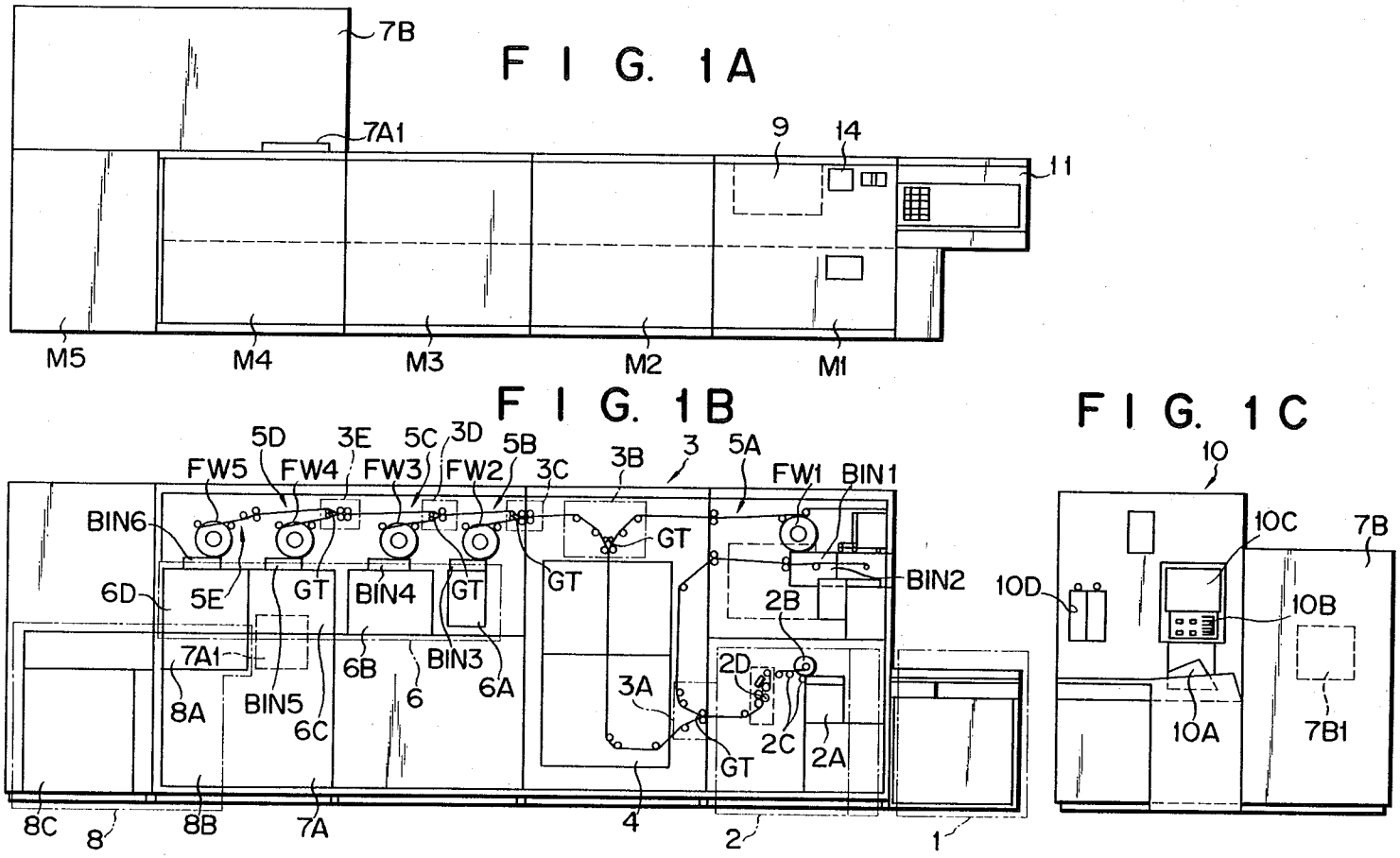
FIGS. 1A, 1B and 1C are a plan view, a vertical side sectional view, and a front view, respectively, of a bank note processing apparatus as one embodiment of the paper sheet processing apparatus according to the present invention.

FIGS. 1A to 1C schematically show the bank note processing apparatus, in which FIG. 1A is a plan view of the apparatus, FIG. 1B is a vertical side sectional view, and FIG. 1C is a front view. The bank note processing apparatus, which is installed in a bank note issuing agency, classifies circulating bank notes withdrawn from city banks into four categories, i.e., correct notes, unfit notes, counterfeit notes, and unmachinable notes, and bundles only the correct notes so that they are returned to the city banks for recirculation. The bank note processing apparatus comprises a batch feeder 1, a takeout device 2, a conveyor/sorter 3, a judgment unit 4, a sorter/collector 5, a batch half-wrapping device 6, a bundle half-wrapping device 7A, a bundle packaging device 7B, a destroying device 8, a control unit 9, and an operating panel section 10.

In one embodiment, a "batch" P consists of 100 banded notes, while a "bundle" includes 10 banded batches. The "correct notes" are defined as notes which are judged normal and valid and are to be returned from the issuing agent for reuse. The "unfit notes" are defined as notes which, although judged normal and valid, are unfit for reuse and are to be destroyed at the issuing agency. The "counterfeit notes" are defined as notes which are judged neither normal nor valid (unidentifiable notes are regarded as invalid). The "unmachinable notes" are defined as notes which cannot be judged due to superposition, skew or short pitch (too short a distance between two adjacent notes in a conveyor path for the following note to be processed with ease). The "counterfeit notes" and "unmachinable notes" are also referred to as "rejectable (or rejected) notes", since they are to be rejected from the bank note processing apparatus. "Fine notes" are defined as those "correct notes" which are relatively fine and clean.

The sorter/collector 5 comprises a rejected note collecting section 5A, different sheet collecting section 5B, a fine note collecting section 5C, a correct note collecting section 5D, and an unfit note collecting section 5E. The conveyor/sorter 3 comprises five conveyor/sorter sections 3A to 3E in the conveyor path, corresponding to the collecting sections 5A to 5E of the sorter/collector 5, respectively. Gates GT are provided at the respective diverging portions of the conveyor/sorter sections 3A to 3E. The collecting sections 5A to 5E are provided with conventional recovery wheels FW1 to FW5, respectively, which take out fed bank notes one by one to collect them in their corresponding collecting boxes (BINs). Among these collecting boxes (BINs), a counterfeit note collecting box BIN1 and an unmachinable note collecting box BIN2 are disposed independently at the rejected note collecting section 5A, lying one upon the other. Collecting boxes BIN3 to BIN6 are arranged at the other collecting sections 5B to 5E, respectively.

The batch half-wrapping device 6 is provided with batch half-wrapping sections 6A to 6D arranged under the collecting boxes BIN3 to BIN6, respectively. The bundle half-wrapping device 7A is disposed under the batch half-wrapping section 6C which underlies the correct note collecting section 5D. The bundle half-wrapping unit 7A has a window 7A1 through which the bank notes are delivered to the bundle packaging device 7B at the back of the bundle half-wrapping device 7A.

The takeout device 2 comprises a collecting section 2A in which are collected a plurality of loose bank notes, a delivery roller 2B for picking up one by one the bank notes collected in the collecting section 2A, a group of conveyor rollers 2C for tranferring the bank notes picked up by the delivery roller 2B, and an inspection section 2D provided in the conveyor path for inspecting the bank notes for unmachinable characteristics (e.g., superposition, skew, short pitch, etc.). The takeout device 2 is prevented from picking up the individual bank notes of a subsequent batch before the processing of a preceding batch is completed. As shown in FIG. 1C, the operating panel section 10 is provided with an inlet portion 10A for fed batches, an operating portion 10B including a ten-key unit above the inlet portion 10A, a monitoring CRT 10C, and a cassette outlet opening 10D. The bundle packaging device 7B has an outlet opening 7B1.

The sections containing the aforementioned devices are formed into ihdividual modules. As shown in FIG. 1A, a feeding module M1 detachably fitted with a feeding stand 11, a judgment module M2, first and second collecting modules M3 and M4, scrapping module M5, and the bundle packaging device 7B are arranged so that they can be attached to or detached from one another. Thus, these modules can optionally be increased or decreased in number depending on applications and functions required. As shown in FIG. 1B, the feeding module M1 contains therein the rejected note collecting section 5A and the takeout device 2 arranged vertically, and the control unit 9 behind them. The judgment module M2 contains the judgment unit 4 and the first and second conveyor/sorter sections 3A and 3B. The first collecting module M3 contains the different sheet collecting section 5B, the fine note collecting section 5C, the batch half-wrapping sections 6A and 6B, and the third and fourth conveyor/sorter sections 3C and 3D. The second collecting module M4 contains the correct note collecting section 5D, the unfit note collecting section 5E, the batch half-wrapping sections 6C and 6D, the fifth conveyor/sorter section 3E, and the shredders 8A and 8B as first and second destroying devices. The scrapping module M5 contains a scrap box 8C.

Figure 2A:
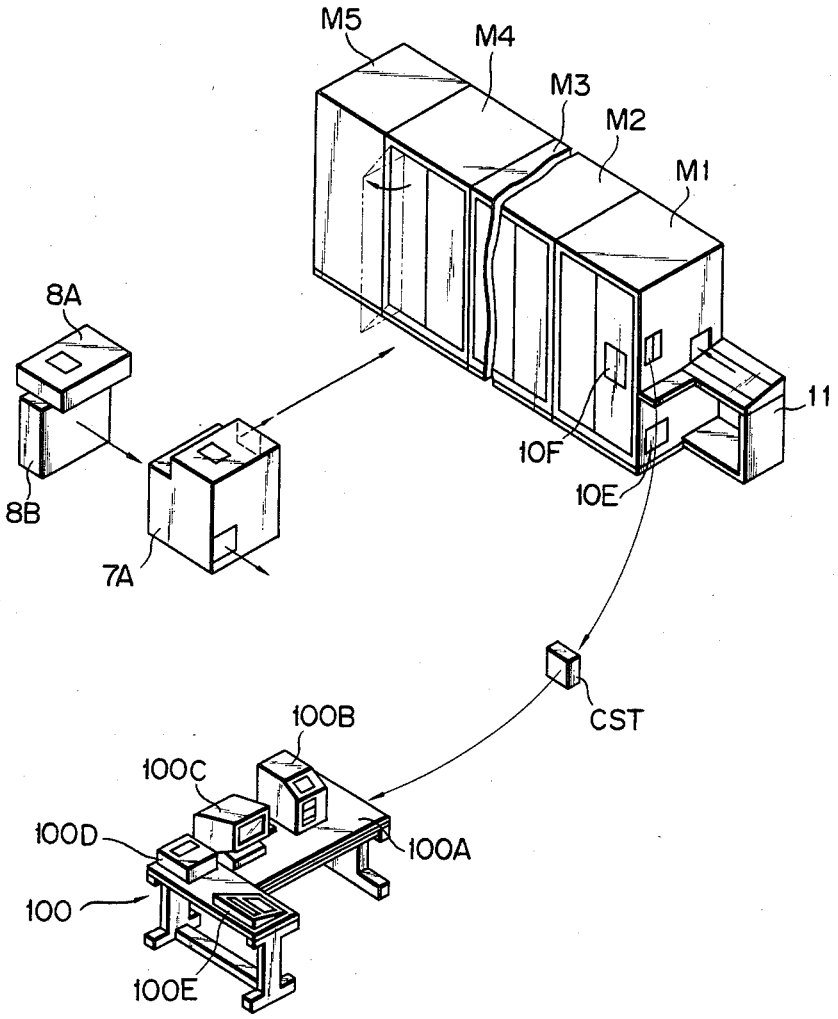
FIGS. 2A and 2B are front and rear perspective views of the bank note processing apparatus, respectively.
Figure 2B:
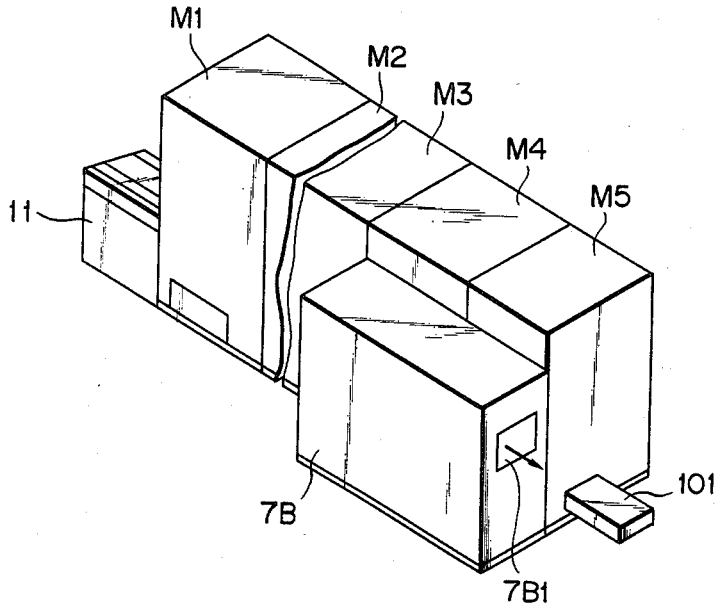
Figure 2C:
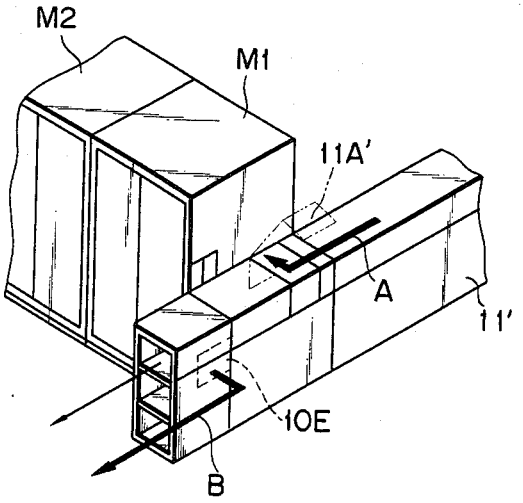
FIG. 2C is a perspective view showing a modification of a batch feeder.

FIG. 2A is a partially disassembled perspective view of the bank note processing apparatus, FIG. 2B is a rear perspective view of the apparatus, and FIG. 2C is a perspective view showing the principal part of a modification of the batch feeder. As shown in FIG. 2A, the modules M1 to M4 have their respective doors. For example, the first and second shredders 8A and 8B and the bundle half-wrapping device 7A can be connected and contained in the module M4 with its door open. Disposed near the bank note processing apparatus is an external operating device 100, whereby a rejected note cassette CST containing rejected notes processed at the rejected note collecting section 5A is taken out in order to inspect the rejected notes for the cause of rejection. The external operating device 100 comprises a desk 100A, an input unit 100B including a ten-key unit, a CRT 100C, a printer 100D, and a keyboard 100E, the units 100B to 100E being set on the desk 100A. A cover 10F for loose note insertion is provided on the flank of the module M1. The bank note processing apparatus is adapted to be in a loose note processing mode when the cover 10F is open. As shown in FIG. 2B, a pipe containing portion 101 containing a cooling pipe, etc., is attached to the back of the bank note processing apparatus.

FIG. 2C shows the modification of one embodiment, in which the batch feeding stand 11 is replaced by a feeding stand 11' which is provided with a belt conveyor capable of longitudinally feeding a plurality of batches at a time. In this modification, a lid 11A' on the top of the feeding stand 11' is lifted when batches or bundles of bank notes are fed manually. In this case, the batches or bundles of bank notes automatically transferred flow in the direction of arrow A to be fed into the bank note processing apparatus. After the processing, the bundles of bank notes are carried in the direction of arrow B to be discharged to the outside through an outlet opening 10E at the lower portion of the module M1.

The construction of various parts of the bank note processing apparatus will now be described in detail.

Figure 3:
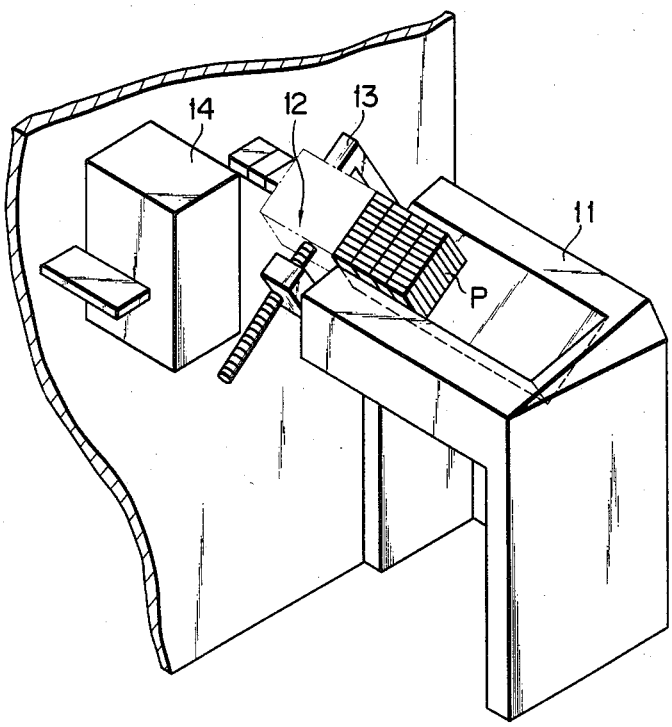
FIG. 3 is a perspective view of a batch feeder of one embodiment.

As shown in FIG. 3, the batch feeder 1 comprises the batch feeding stand 11, a batch extruding section 12, an unmachinable batch removing section 13, and a band cutting section 14. The batch feeding stand 11 and the batch extruding section 12 constitute an example of batch takeout means for taking out and feeding one by one those batches which are each formed of a predetermined number of (e.g., 100) banded bank notes. The band cutting section 14 is an example of band cutting means for cutting bands wound around the batches taken out by the batch takeout means.

Figure 4:
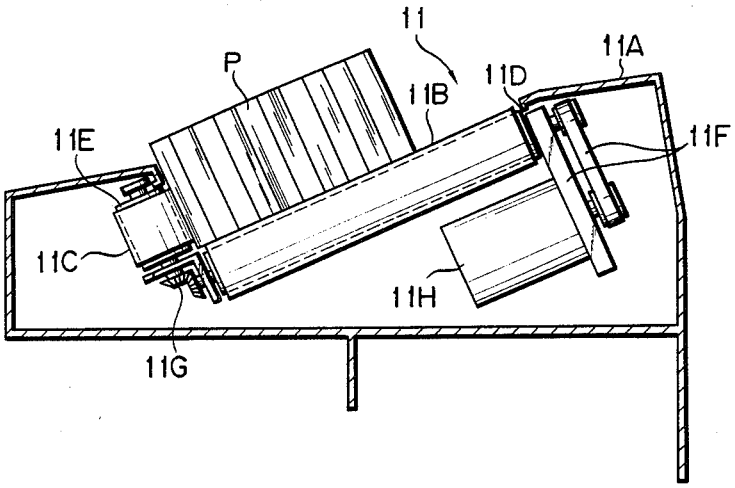
FIG. 4 is a vertical side sectional view of a batch feeding stand.

As shown in FIG. 4, the batch feeding stand 11 comprises a frame 11A having a slanted top surface and a groove thereon, a first belt 11B adapted to transfer the batches in the longitudinal direction (at right angles to the drawing plane) along the slanted top surface, a second belt 11C extending at right angles to one end portion of the first belt 11B for regulating the batches in position, rollers 11D and 11E wound with the belts 11B and 11C, respectively, and a drive belt 11F, a set of gears 11G and a motor 11F for driving the rollers 11D and 11E.

Figure 5:
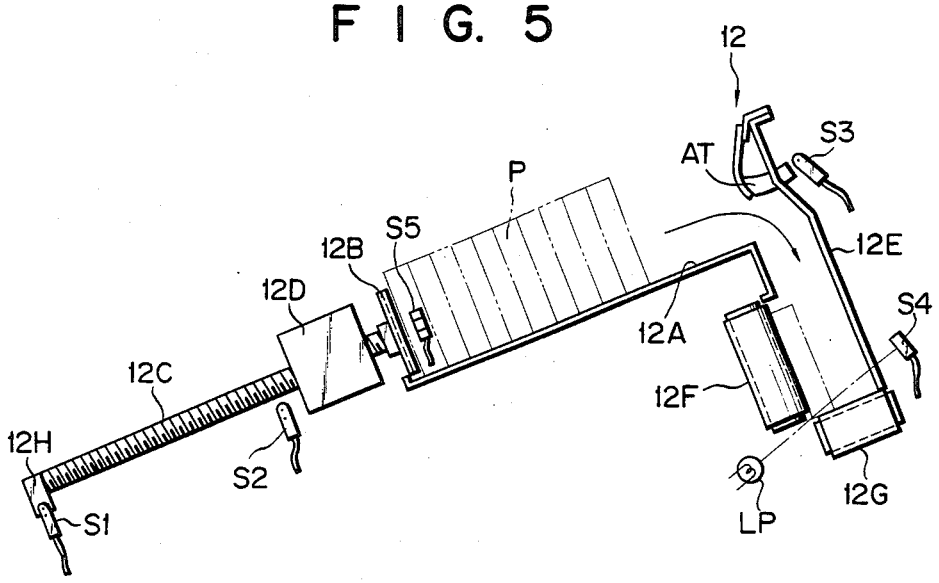
FIG. 5 is a vertical side sectional view of a batch extruding section.

As shown in FIG. 5, the batch extruding section 12 comprises a slanted floor 12A on the extension of the belt 11B, a backup plate 12B capable of moving from the lower end portion of the floor 12A along the slope, a ball screw shaft 12C attached to the backup plate 12B, a motor 12D for driving the ball screw shaft 12C, a guide 12E for downwardly guiding the batches P of bank notes forced out from the forward end portion of the floor 12A, belts 12F and 12G carrying the batches dropped thereon, and a screening plate 12H attached to the rear end portion of the ball screw shaft 12C. The batch extruding section 12 further comprises a first sensor S1 for detecting a position of the screening plate 12H to determine the initial position of the backup plate 12B, a second sensor S2 for detecting a passage of the screening plate 12H to determine the terminal end position of the backup plate 12B, a third sensor S3 adapted to be actuated by an actuator AT which rocks as the batches are forced out and which delives a stop signal for the motor 12D, a fourth sensor S4 adapted to be actuated as a light beam from a light source LP is intercepted by the dropped batch and to deliver an output signal for determining the timing for the start of the drive for the conveyor belts 12F and 12G, and a fifth sensor S5 adapted to detect the existence of the batches over the backup plate 12B and to deliver an output signal to determine the timing for stopping the motor 12D.

According to the batch feeder 11 constructed in this manner, 10 batches placed on the batch feeding stand 11 are carried onto the backup plate 12B as the belts 11B and 11C are driven by the rotation of the driving rollers 11D and 11E. The moment the batches cross the sensor S5 the driving rollers 11D and 11E and the belts 11B and 11C are stopped, and the transfer of the batches is stopped. Then, as the backup plate 12B is actuated to push the batches obliquely upward, the uppermost batch slides down the guide 12E on the other side of the floor 12A. Thus, the batches are fed one by one. As the motor 12D rotates, the shaft 12C moves forward to cause the backup plate 12B to force out each batch. When the batch moves forward and the light-receiving portion of the sensor S3 is darkened, the motor 12D stops. Thereafter, the motor 12D rotates intermittently, so that the batches fall one after another from the floor 12A onto the belts 12F and 12G. The moment each dropped batch screens the sensor S4, the motor 12D stops, and the belts 12F and 12G start to move. Thus, the motor 12D rotates intermittently at regular time intervals to feed the batches one by one. The sensor S2 is located in a position such that all the 10 batches can be fed. Thus, the motor 12D rotates as the screening plate 12H at the rear end portion of the shaft 12C crosses the sensor S2, and stops when the plate 12H crosses the sensor S1. The moment the motor 12D stops, the rollers 11D and 11E of the feeding stand 11 start to rotate, and another ten batches P are carried onto the backup plate 12B by running of the belts 11B and 11C. This cycle of operation is repeated. If no batch is detected by the sensor S5 near the backup plate 12B within a given time, the belts 11B and 11C go on moving, and the CRT or a buzzer makes an indication to urge an operator to place batches on the feeding stand 11.

Figure 6:
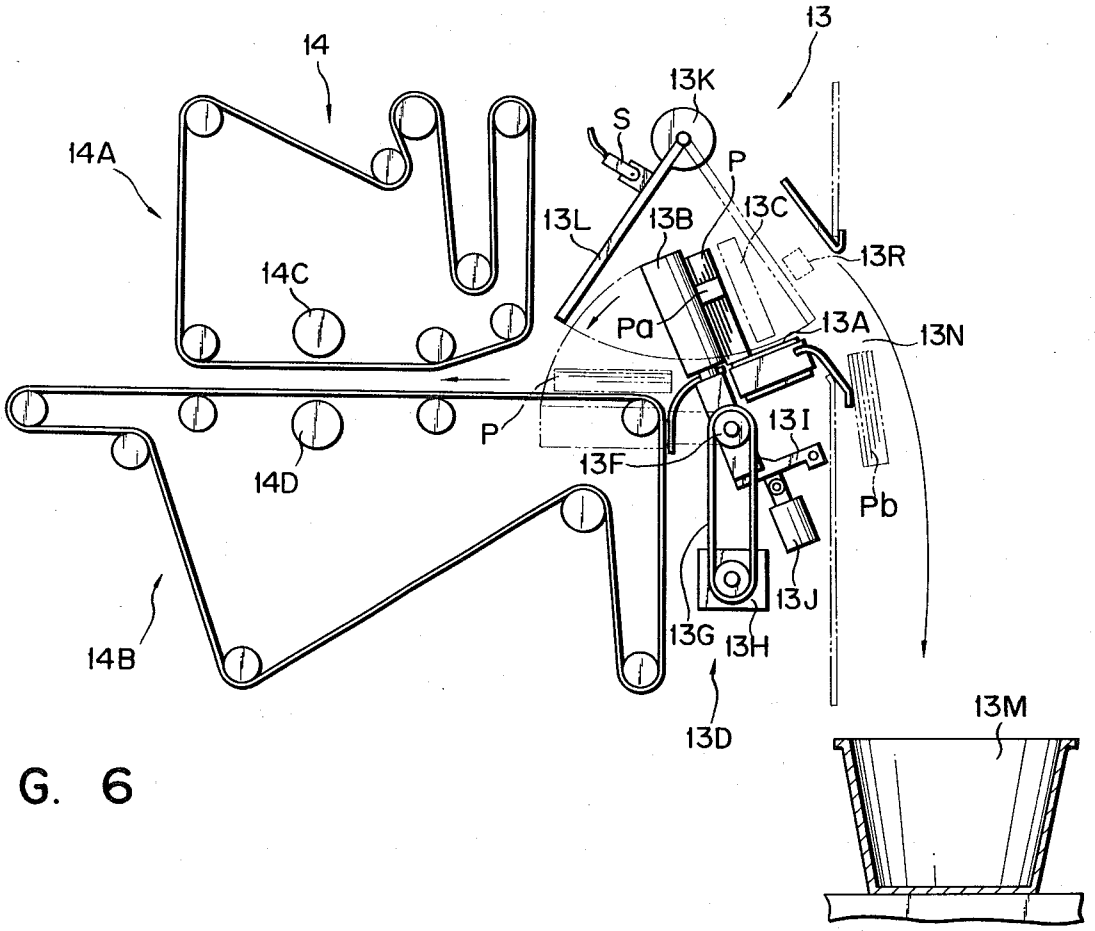
FIG. 6 is a vertical sectional view of an unmachinable batch removing section.

Referring now to FIG. 6, the construction of the unmachinable batch removing section 13 and the band cutting section 14 will be described in detail. The unmachinable batch removing section 13 comprises a delivery table 13A for delivering the extruded batches, a set of guide rollers 13B for guiding the batches, a metal piece detecting member 13C in the middle of the conveyor path, a rocking mechanism 13D for rocking the guide rollers 13B, a rotary solenoid 13K over the guide rollers 13B, a lever 13L nested with the guide rollers 13B and adapted to strike down to the side of an outlet opening 13N the batches rocked by the rotary solenoid 13K and delivered, a basket 13M set under the outlet opening 13N, and an obverse/reverse detector 13R for detecting the obverse or reverse of the delivered batch of bank notes.

Figure 7:
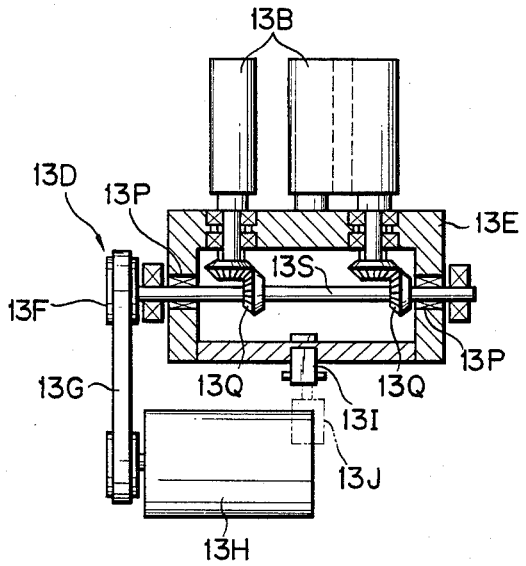
FIG. 7 is a side view of a rocking mechanism for rollers.

The rocking mechanism 13D fcr the guide rollers 13B is constructed as shown in FIG. 7. Namely, the rocking mechanism 13D comprises a frame 13E rotatably supporting the guide rollers 13B, a rotating shaft 13S mounted on the frame 13E by means of one-way clutches 13P and rotatably supporting the frame 13E, a group of gears 13Q including one set of bevel gears fixed to one ends of the guide rollers 13B and the other set of bevel gears fixed to the middle portion of the shaft 13S, meshing with the gears of the first mentioned set, a pulley 13F attached to one end of the shaft 13S, a drive motor 13H, a belt 13G passed around the pulley 13F and the pulley of the motor 13H, a stopper 13I for determining the initial position of the frame 13E, and a plunger solenoid 13J for rocking the stopper 13I to release the frame 13E. When the rocking mechanism 13D is in operation, the stopper 13I is removed from the frame 13E by the energization of a plunger solenoid 13J, so that the guide rollers 13B rock in the counterclockwise direction of FIG. 6 by gravity. In returning the guide rollers 13B to the initial position, they are rocked clockwise by the drive of the motor 13H.

According to the unmachinable batch removing section 13, the batch on the belts 12F and 12G of the batch feeder 1 is checked for the existence of clips, setting pins or other metal pieces therein by the metal piece detector 13C as it passes through the detector 13C. Then, the batch is delivered from the belts 12F and 12G to the rollers 13B. The belts 12F and 12G and the rollers 13B stop when the movement of the batch to a predetermined position is detected by a sensor (not shown). If a metal piece or pieces are found in the batch by the metal piece detector 13C, the rotary solenoid 13K is excited after the belts 12F and 12G and the rollers 13B are stopped. As a result, the batch is discharged into the basket 13M outside the apparatus by the lever 13L. The moment the solenoid 13K is excited, the next batch is fed onto the belts 12F and 12G. The discharged batch is checked by the operator, and is fed again into the apparatus to be processed thereby. The batch undergoes the same processing if it is found to be reversed by the obverse/reverse detector 13R.

In the present embodiment, as described above, the unmachinable batch is defined as a batch which is accompanied with a metal piece or pieces or is fed reversed. The metal piece detecting member 13C and the obverse/reverse detector 13R constitute an example of unmachinable batch detecting means. Those batches which are judged free from any metal piece by the metal piece detector 13C are delivered to the band cutting section 14.

Figure 8B:
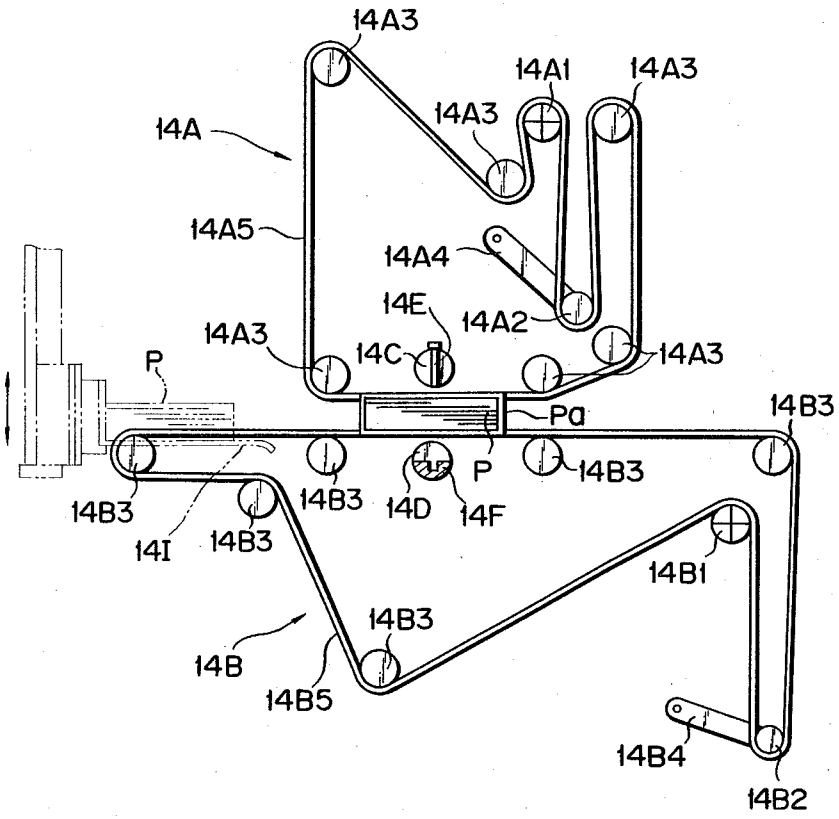
FIGS. 8A and 8B are a vertical front sectional view and a vertical side sectional view of a band cutting section, respectively.
Figure 8A:
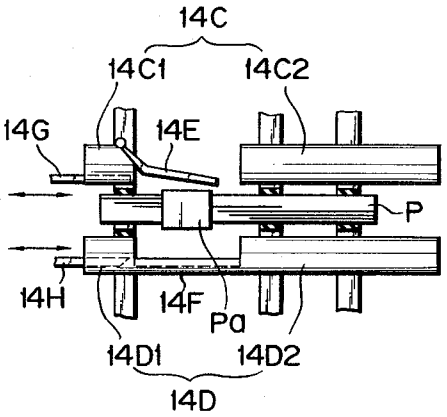

As shown in FIGS. 8A and 8B, the band cutting section 14 comprises an upper conveyor section 14A including a plurality of rollers 14A3, a driving roller 14A1, a moving roller 14A2 attached to a rocking lever 14A4, and a belt 14A5; a lower conveyor section 14B including a plurality of rollers 14B3, a driving roller 14B1, a moving roller 14B2 attached to a rocking lever 14B4, and a belt 14B5; upper and lower squeezers 14C and 14D arranged in the middle of a conveyor path defined between the upper and lower conveyor sections 14A and 14B at right angles thereto so that the two squeezers 14C and 14D can approach and move away from each other, a band catch lever 14E attached to the upper squeezer 14C, a cutter guide 14F formed along the lower squeezer 14D, a band catch pin 14G capable of moving horizontally under the band catch lever 14E, a cutter 14H movable along the cutter guide 14F, and a backup plate 14I for carrying out the unbanded bank notes.

As shown in FIG. 8A, the upper and lower squeezers 14C and 14D are arranged so that they hold therebetween the other portions of the fed batch P than that portion which is wound with a band Pa. The upper squeezer 14C consists of a pair of rods 14C1 and 14C2. The band catch lever 14E is rockably attached to the one rod 14C1, and is urged in the clockwise direction of FIG. 8A by an urging member (not shown). The position shown in FIG. 8A is defined as a regulated position of the lever 14E. The band catch pin 14G is movably held in a groove formed in the bottom portion of the rod 14C1. The lower squeezer 14D consists of a pair of rods 14D1 and 14D2, and the cutter guide 14F is provided between the two rods 14D1 and 14D2. The cutter 14H is movably contained in one rod 14D1. The backup plate 14I is nested with the belt 14B5 and can move vertically.

Figure 9B:
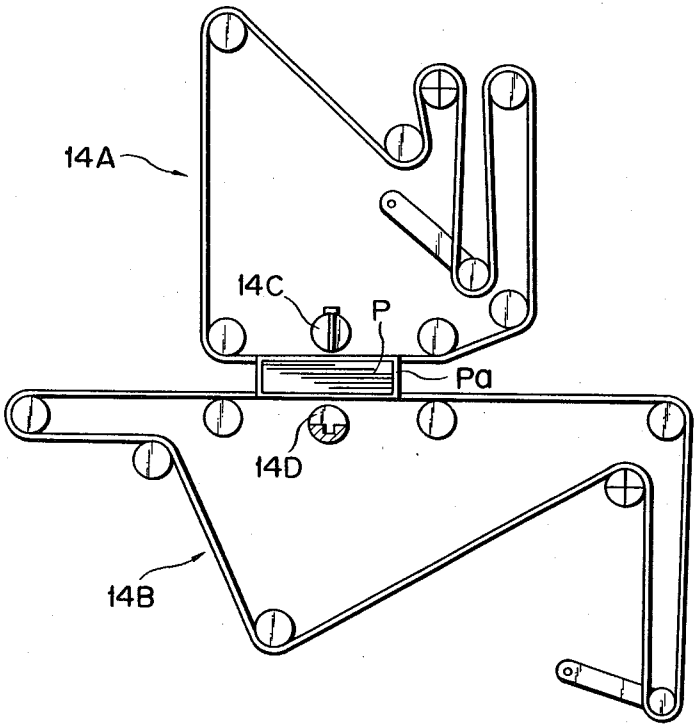
FIGS. 9B, 10B, 11B, 12B, 13B, 14B and 15 are vertical side sectional views for schematically illustrating the band cutting/removing operation.
Figure 9A:
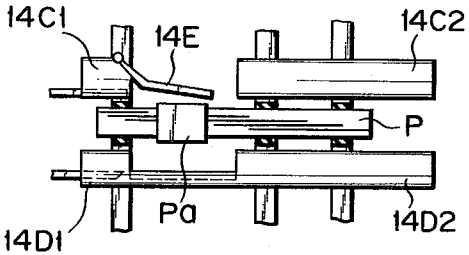
FIGS. 9A, 10A, 11A, 12A, 13A and 14A are vertical front sectional views for schematically illustrating the band cutting/removing operation.
Figure 10B:
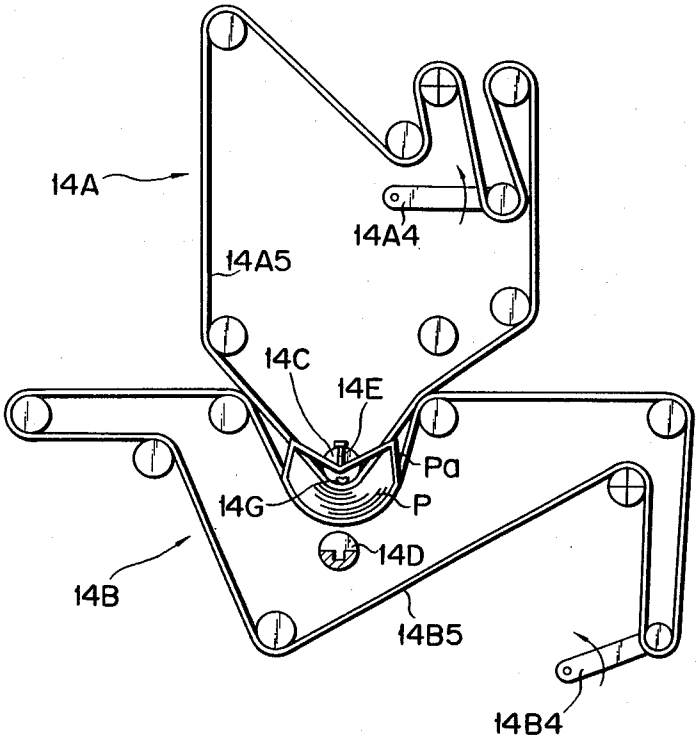
Figure 10A:
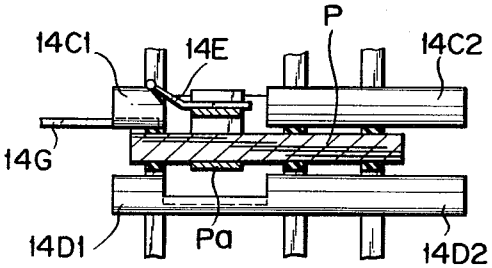

The band cutting section 14 of this construction is operated as shown in FIGS. 9A to 15. A batch P supplied from the batch feeder 1 stops at the position sandwiched between the upper and lower squeezers 14C and 14D in the middle of the conveyor path between the upper and lower conveyor sections 14A and 14B, as shown in FIG. 9B. As shown in FIG. 9A, the batch P is held between the rods 4C1, 14C2, 14D1 and 14D2 at those portions thereof which are free from the wrapping band Pa. Then, as shown in FIGS. 10A and 10B, the upper and lower squeezers 14C and 14D both move down so that the batch P is curved to project downward. As a result, a gap is formed between the upper surface of the batch P and the top portion of the wrapping band Pa, and the band Pa touches the bottom face of the band catch lever 14E. At the same time, the rocking levers 14A4 and 14B4 of the upper and lower conveyor sections 14A and 14B rock counterclockwise as indicated by the arrows of FIG. 10B to facilitate the shift of the belts 14A5 and 14B5, and promote smooth squeezing action.

Figure 11B:
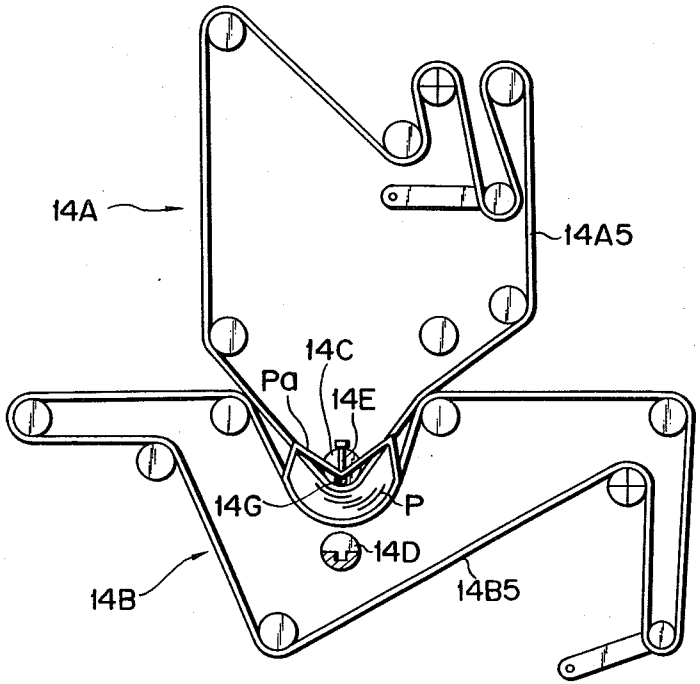
Figure 11A:
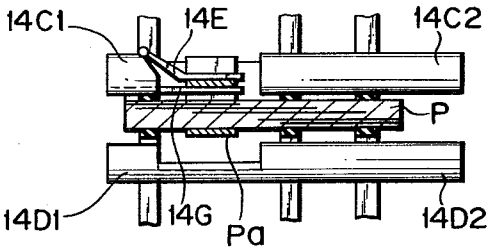
Figure 12B:
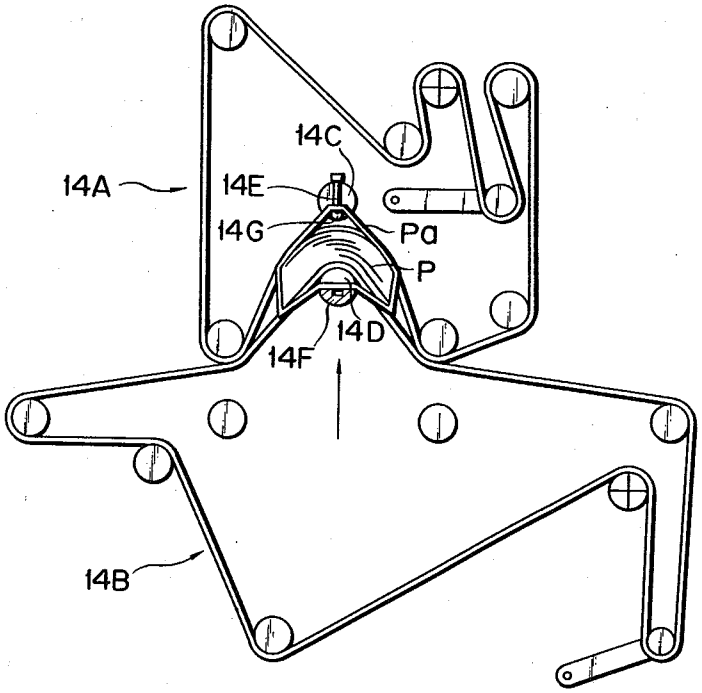
Figure 12A:
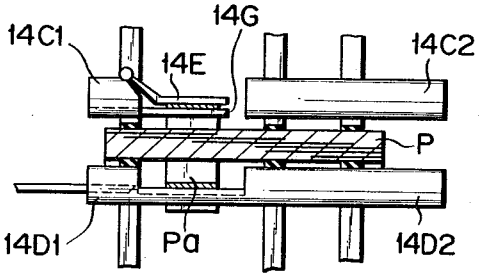
Figure 13B:
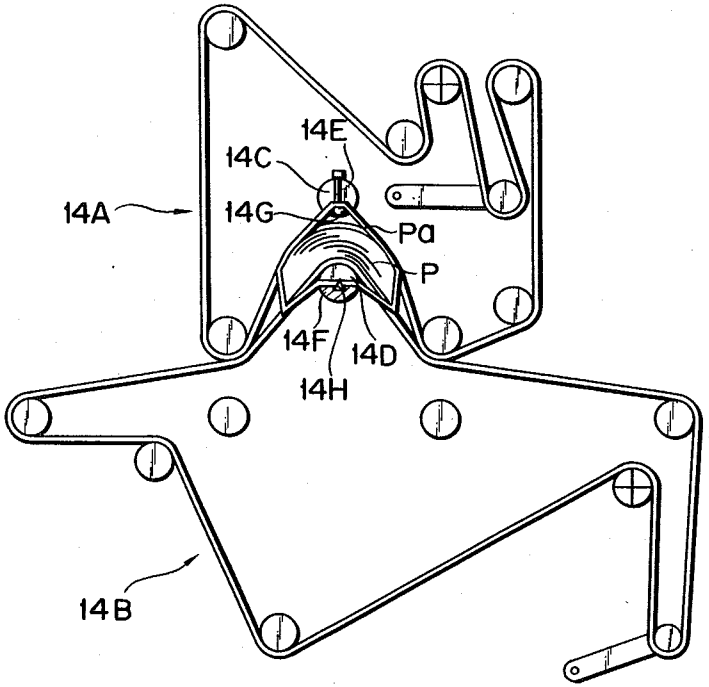
Figure 13A:
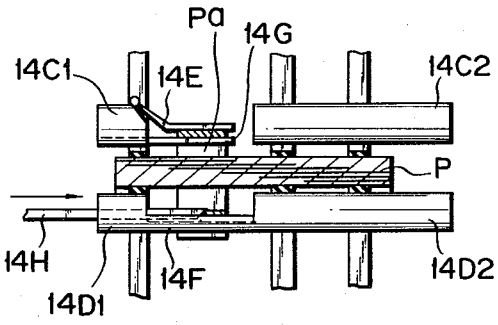

Thereafter, as shown in FIGS. 11A and 11B, the band catch pin 14G, contained in one rod 14C1 of the upper squeezer 14C, advances to the right as indicated by the arrow of FIG. 11A and locates under the top portion of the wrapping band Pa. Thus, the top portion of the wrapping band Pa is nipped by the band catch lever 14E and the band catch pin 14G. Then, as shown in FIGS. 12A and 12B, the upper and lower squeezers 14C and 14D both move up so that the batch P is curved to project upward. At this time, the top portion of the wrapping band Pa is held between the band catch lever 14E and the band catch pin 14G, and its bottom portion abuts against the cutter guide 14F causing the wrapping band Pa to be strained. At this point, as shown in FIGS. 13A and 13B, the cutter 14H, contained in one rod 14D1 of the lower squeezer 14D, advances to the right as indicated by the arrow of FIG. 13A along the groove of the cutter guide 14F, and touches and cuts the bottom portion of the wrapping band Pa engaging the upper surface of the cutter guide 14F.

Figure 14B:
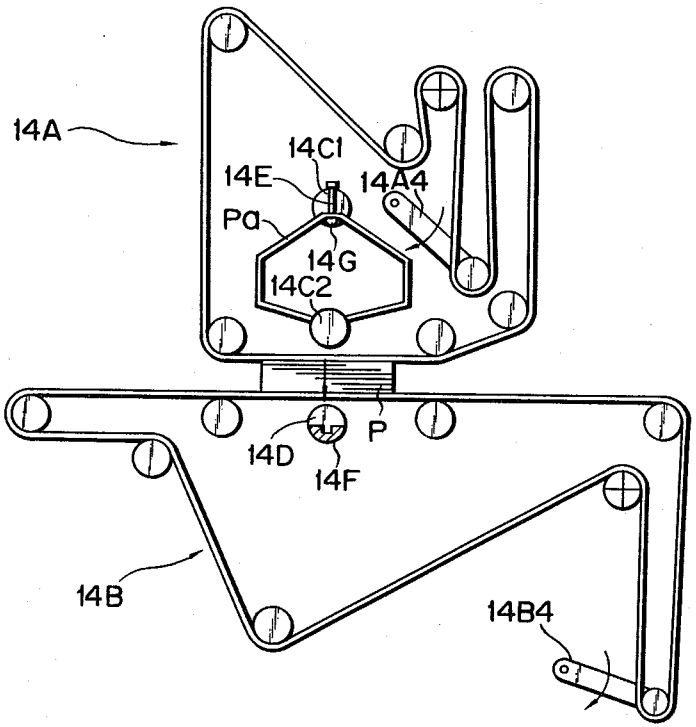
Figure 14A:
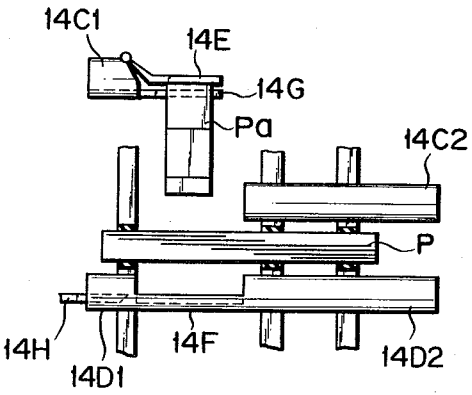
Figure 15:
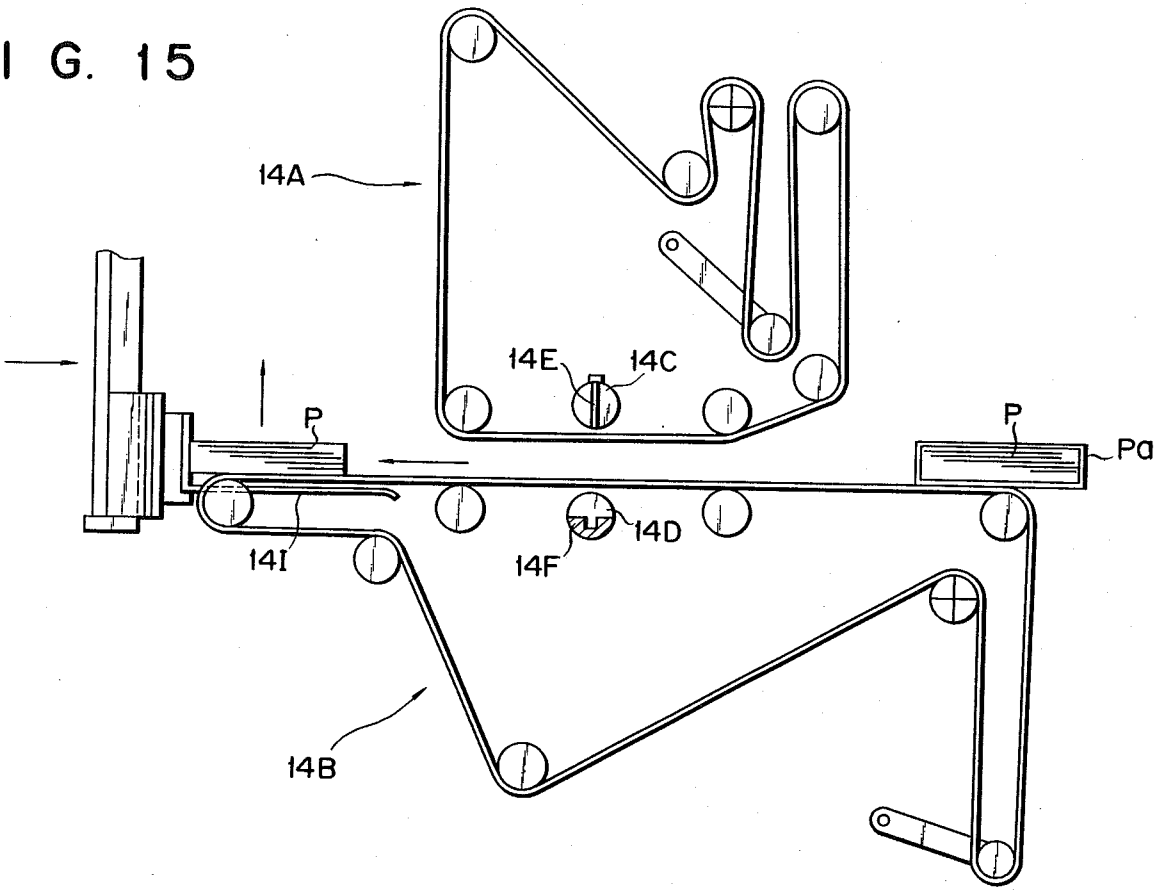

Thereafter, as shown in FIGS. 14A and 14B, only the lower squeezer 14D moves down to resume its initial position. The cut wrapping band Pa is left held between the band catch lever 14E and the band catch pin 14G attached to one rod 14C1 of the upper squeezer 14C. At this time, the rocking levers 14A4 and 14B4 of the upper and lower conveyor sections 14A and 14B rock clockwise as indicated by the arrows of FIG. 14B to resume the original state. Finally, as shown in FIG. 15, the upper and lower conveyor sections 14A and 14B are driven to convey the unbanded bank notes, and the awaiting backup plate 14I enters the conveyor path to receive the bank notes delivered thereto. The bank notes received by the backup plate 14I are transferred as the backup plate 14I moves up, and are delivered to the collecting section of the takeout device 2. The cut wrapping band Pa is carried into the rejected note collecting section 5A, which will be described in detail below.

Figure 16:
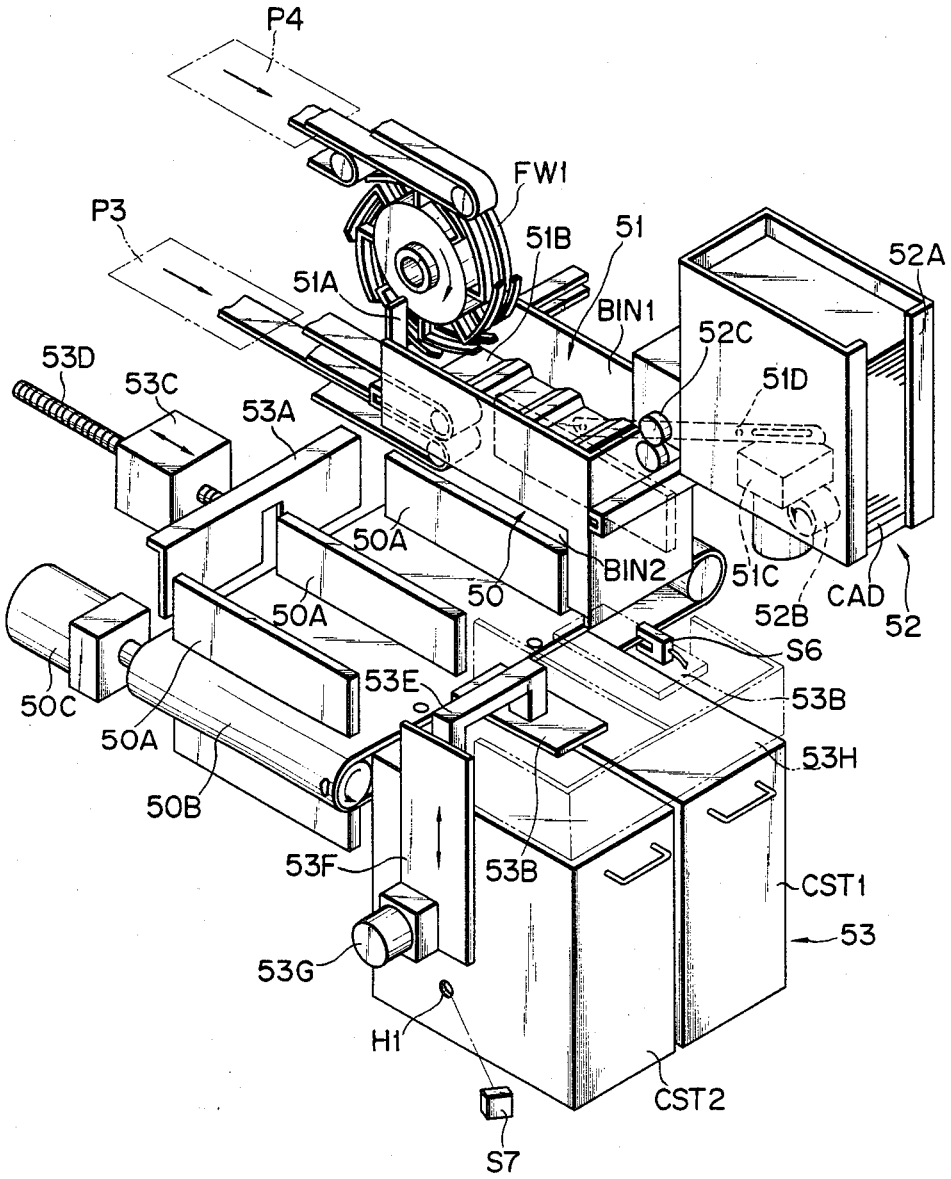
FIG. 16 is a perspective view of a rejected note collecting section.

As shown in FIG. 16, the rejected note collecting section 5A comprises an unmachinable note collector 50 including the unmachinable note collecting box BIN2, a counterfeit note collector 51 including the counterfeit note collecting box BIN1, a classification card issuing unit 52, and a cassette collector 53. In the unmachinable note collector 50, unmachinable notes P3 delivered by the conveyor are collected in piles. The unmachinable note collector 50 comprises a conveyor belt 50B having a plurality of upright partition plates 50A and moving horizontally at right angles to the course of the unmachinable notes P3, and a conveyor belt driving motor 50C. The unmachinable notes P3 collected on the conveyor belt 50B are moved to a predetermined position with the aid of a sensor (not shown) for detecting the movement of the conveyor belt 50B and a positioning sensor S6 which detects perforations bored through one side edge portion of the conveyor belt 50B at regular intervals. The upright partition plates 50A on the conveyor belt 50B are arranged at regular intervals. Each two adjacent partition plates 50A may define two walls of the unmachinable note collecting box BIN2 extending along the course of the unmachinable notes P3. The conveyor belt 50B moves at predetermined pitches. After the conveyor belt 50B is moved by a pitch, the two walls of the unmachinable collecting box BIN2 are defined by another adjacent pair of upright partition plates 50A.

The counterfeit note collector 51 is constructed so that counterfeit notes P4 delivered by the conveyor belts are received for deceleration by curved grooves defined between the adjacent vanes of the recovery wheel FW1 rotating at low speed in the same direction as the course of the counterfeit notes P4, and are then collected in piles. In the counterfeit note collector 51, as in the correct and unfit note collecting sections 5D and 5E, the curved grooves of the recovery wheel FW1 rotate in synchronism with the counterfeit notes P4 delivered to the recovery wheel FW1, so that the counterfeit notes P4 can securely enter the individual curved grooves of the wheel FW1. The counterfeit notes P4 in the curved grooves of the recovery wheel FW1 are turned at about 180°. Thus, the notes P4 are prevented from advancing by a fixed plate 51A facing the forward ends of the notes P4. As the recovery wheel FW1 rotates, therefore, the counterfeit notes P4 are gradually drawn out from the curved grooves to be collected uniformly in the counterfeit note collecting box BIN1.

A bottom plate 51B of the counterfeit note collecting box BIN1 can move horizontally. As a motor 51C is rotated, the bottom plate 51B is moved to the outside of the counterfeit note collecting box BIN1 with the aid of an arm 51D so that the collected counterfeit notes P4 can be discharged into the unmachinable note collecting box BIN2 which is located under the counterfeit note collecting box BIN1. Thus, the counterfeit notes P4 collected in the counterfeit note collecting box BIN1 are stacked on the unmachinable notes P3 collected in the unmachinable note collecting box BIN2.

The wrapping band Pa cut by the band cutting section 14 is placed in the counterfeit note collecting box BIN1, for each corresponding batch being processed currently. Namely, the wrapping band Pa is put on the bottom plate 51B of the counterfeit note collecting box BIN1 before the first counterfeit note P4 of the processed batch is collected. Thus, the wrapping band Pa is first placed in the counterfeit note collecting box BIN1, and the counterfeit notes P4 are then stacked on the wrapping band Pa.

The classification card issuing unit 52 is intended to discharge one by one classification cards CAD piled vertically in a card magazine 52A onto the collected counterfeit notes P4. The classification cards CAD have their respective identification numbers thereon. As a takeout roller 52B disposed under the classification cards CAD makes one revolution, the forward end of a classification card CAD reaches discharge rollers 52C. The classification card CAD is discharged as the discharge rollers 52C rotate. While the classification card CAD is being discharged, the identification number on the classification card CAD is read by a reading head (not shown) and stored in a magnetic disk in the control unit 9. The discharged classification card CAD is collected in the counterfeit note collecting box BIN1.

The cassette collector 53 is intended to collect the unmachinable notes P3, wrapping bands Pa, counterfeit notes P4, and classification cards CAD on the conveyor belt 50B in a cassette. The cassette collector 53 comprises first and second cassettes CST1 and CST2 arranged side by side, an extruding plate 53A for pushing the bank notes and other sheets on the conveyor belt 50B into the cassette CST1 or CST2, and two pressure plates 53 for thrusting the sheets into their corresponding cassette CST1 or CST2. The use of the paired cassettes CST1 and CST2 and pressure plates 53B enables one to employ the second cassette CST2 when the first cassette CST1 is filled up. Thus, the time required for cassette replacement is eliminated.

The cassette collector 53 is further provided with a ball screw shaft 53D which is moved longitudinally as a motor 53C is rotated. As the ball screw shaft 53D moves in this manner, the extruding plate 53A fixed to the forward end of the shaft 53D moves in the same direction to force out the bank notes and other sheets. The extruded sheets are positioned by a plate 53H on the cassettes CST1 and CST2. The extruding plate 53A and the cassettes CST1 and CST2 face one another with the conveyor belt 50B between them. Thus, the single extruding plate 53A serves the two cassettes CST1 and CST2.

Each pressure plate 53B is coupled to a motor 53G by means of an arm 53E and a moving plate 53F. The pressure plate 53B is normally on stand-by over the cassettes CST1 or CST2. As the motor 53G rotates, the pressure plate 53B is moved down through the medium of a chain to thrust the bank notes and other sheets into the cassette CST1 or CST2.

The cassettes CST1 and CST2 are each formed of an open-topped box containing therein a backup plate (not shown) which can stop at any position inside the box by friction. The backup plate is pressed downward as required by the pressure plate 53B due to the bank notes and other sheets contained in the cassette. When the backup plate reaches its lowermost position, it is detected by a sensor S7 through a hole H1 formed in the first cassette CST1. Thereupon, the sensor S7 delivers a full-up signal. In response to the full-up signal, the other cassette gets ready to receive the sheets.

The operation of the rejected note collecting section 5A will now be described in detail. First, when the wrapping band Pa is cut and removed from the batch P by the batch feeder 1, it is immediately carried into the counterfeit note collecting box BIN1. The batch feeder 1 operates irrespectively of the transfer of the wrapping band Pa, and the 100 bank notes constituting the bath P are taken out one after another by the takeout device 2. Now assume that the batch P includes one counterfeit note and one unmachinable note, and that these rejectable notes are collected in their corresponding collecting boxes BIN1 and BIN2 after judgment. Then, the counterfeit note P4 is placed on the aforesaid wrapping band Pa in the counterfeit note collecting box BIN1. When the last or 100th bank note is judged, or when its rear end passes a sensor (not shown) at the entrance of the counterfeit note collecting box BIN1, the classification card takeout roller 52B of the classification card issuing unit 52 starts to rotate, thereby discharging a classification card CAD onto the counterfeit note P4. Thereafter, the motor 51C for driving the bottom plate 51B of the counterfeit note collecting box BIN1 rotates, so that the bottom plate 51B is moved to the outside of the counterfeit note collecting box BIN1 by means of the arm 51D. Thus, the wrapping band Pa, the counterfeit note P4, and the classification card CAD are stacked on the unmachinable note P3 in the order named.

Then, the conveyor belt driving motor 50C of the unmachinable note collector 50 rotates to actuate the conveyor belt 50B, and the upright partition plates 50A move one pitch. Hereupon, the perforations in the conveyor belt 50B are detected by the sensor S6, and the motor 50C and the belt 50B are stopped. At the same time, the motor 53C for the extruding plate 53A starts to rotate, so that the sheets piled on the conveyor belt, the unmachinable note P3, the wrapping band Pa, the counterfeit note P4, and the classification card CAD (in that order) are pushed out over the first cassette CST1 by the extruding plate 53A. Thereupon, a sensor (not shown) detects that the extruding plate 53A has reached its front position, delivering a detection signal. In response to this detection signal, the motor 53G for the pressure plate 53B starts to rotate. At the same time, the motor 53C for the extruding plate 53A is reversed to restore the extruding plate 53A to its original position, and then stops. When the pressure plate 53B is moved a predetermined stroke, the motor 53G is reversed to restore the pressure plate 53B to its original position, and then stops.

This cycle of operation is repeated, and thus batches and wrapping bands can be classified by the use of classification cards CAD.

When the cassette CST1 is filled up with the bank notes and other sheets, the conveyor belt 50B moves two pitches so that subsequent sheets are collected in the other cassette CST2. The takeout of the next batch can be started after the detection of the movement of the conveyor belt 50B without waiting until the aforesaid processing cycle is ended. Naturally, the introduction of the wrapping band Pa into the counterfeit note collecting box BIN1 must be completed by this time.

The conveyor path for the unmachinable notes P3 is longer than that for the counterfeit notes P4. If neither unmachinable notes nor counterfeit notes are found in a batch, only the wrapping band Pa and classification card CAD are placed in the cassette CST1. Hereupon, the classification card CAD may be put directly into the cassette first or last without losing its effect. The following effect may be obtained by interposing the wrapping band Pa between the counterfeit notes and unmachinable notes. Even if many counterfeit notes are found, they need not be counted anew, since they have already been counted by the processing apparatus. The unmachinable notes have not, however, been counted yet. Thus, it is necessary only that only the unmachinable notes P3 sorted by the wrapping band Pa be counted anew, so that the cassette processing can be speeded up. The wrapping band Pa can be put directly into the cassette disregarding the speed of the cassette processing.

The batch half-wrapping device 6 is intended to half-wrap in 100-sheet batches the notes which are delivered to the individual collecting sections 5B to 5E and collected in the collecting boxes. For example, a bundling device previously proposed by the present inventor (Japanese Patent Application No. 153546/82, filed on Mar. 31, 1982; U.S. patent application Ser. No. 480,902, filed on Mar. 31, 1983, EPC application No. 83102905-3, filed on Mar. 23, 1983) may be used for the batch half-wrapping device 6. According to this bundling device, 100 paper sheets collected on the backup plate of each collecting box are transferred to a carrier by way of the recovery wheels FW2 to FW5, and the carrier is led to a bundling section. Then, a thermal tape is wound around the batch on the carrier, and both ends of the tape are welded together by heat to seal the batch. Thereafter, the carrier is turned and located on the conveyor path, and is tilted so that the sealed batch slides down to the positon for the next process.

In the batch half-wrapping section 6C of the batch half-wrapping device 6 right under the correct note collecting section 5D, half-wrapped or banded batches can be fed to the bundle half-wrapping device *7a* under the batch half-wrapping section 6C. The batch half-wrapping section 6D corresponding to the unfit note collecting section 5E over the destroying device 8 has two selective operation modes. In one of these modes, the batch half-wrapping section 6D makes a batch. In the other mode, 100 sheets collected in the section 6D are tranferred to the conveyor path to be delivered to the destroying device 8 without being half-wrapped.

The bundle half-wrapping device 7A is intended to half-wrap or band 10 batches of correct notes processed at the batch half-wrapping section 6C. For example, a bundling device previously proposed by the present inventor (Japanese Patent Application No. 158531/80, filed on Nov. 11, 1980; U.S. patent application Ser. No. 318,856, filed on Nov. 6, 1981; British Patent Application No. 8133508, filed on Nov. 6, 1981; German Patent Application No. P 3144820-8, filed on Nov. 11, 1981) may be used for the bundle half-wrapping device 7A. According to this bundling device, batches delivered from the batch half-wrapping section 6C are placed on a carrier with a high profile. When 10 batches are stacked on the carrier, the carrier is led to a bundling section, where it is turned for crossed banding. A bundle made in this manner is transferred to the bundle packaging device 7B through the rear window 7A1.

Figure 17A:
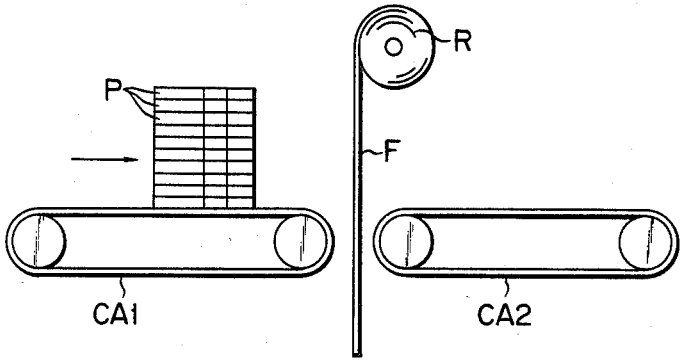
FIGS. 17A and 17B are side views for schematically illustrating the bundle packaging operation.
Figure 17B:
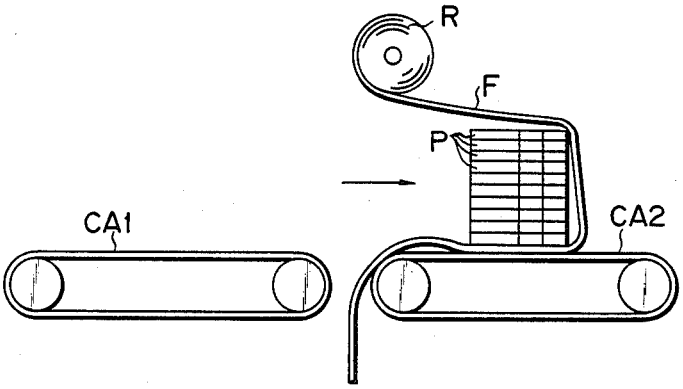
Figure 17C:
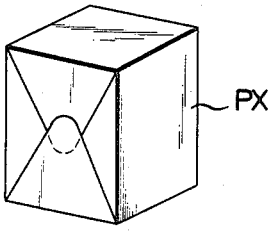
FIG. 17C is a perspective view of a packaged bundle.

The bundle packaging device 7B is intended to package the bundle half-wrapped by the bundle half-wrapping device 7A. For example, a conventional shrink wrapping device may be used for the bundle packaging device 7B. In this shrink wrapping device, as shown in FIG. 17A, one end portion of a heat-contractile film F supplied from a roll R is hung down between a facing pair of conveyors CA1 and CA2, and the bundle P is placed on the conveyor CA1 to be fed thereby in the direction of the arrow of FIG. 17A. After the bundle P touches the film F, it is transferred to the other conveyor CA2 to be further advanced thereby, as shown in FIG. 17B. When three faces of the bundle P are covered with the film F, the bundle P is stopped. Then, the film F is put on the uncovered portion of the bundle P from both upper and lower sides. In this state, the contact portions are fused by heat and joined together. Then, the fused portion is cut as indicated by two-dot chain line in FIG. 17C. Thereafter, the corner portions are folded in to complete a packaged bundle PX, as shown in FIG. 17C.

As shown in FIG. 1B, the destroying device 8 comprises the two shredders 8A and 8B and the scrap box 8C. The first shredder 8A cuts unfit notes into small pieces, while the second shredder 8B pulverizes the pieces. The pulverized pieces of unfit notes are discharged into the scrap box 8C by, for example, blast.

The control unit 9 comprises a storage device (not shown in detail) such as a magnetic disk for storing the results of inspection and judgment by the inspection section 2D in the takeout device 2 and the judgment unit 4 for each processed batch, a control circuit for controlling the various sections on the basis of outputs from the individual sensors, and a central processing unit (CPU) for timing the control of the individual sections and delivering processing instructions.

Now the operation of the bank note processing apparatus as a whole will be described.

The operator supplies the batch feeder 11 with 10 batches as a unit. The supplied batches are taken out one by one and fed by the batch conveyor belts 11B and 11C. The metal piece detector 13C, which is provided in the middle of the conveyor path, detcts clips, setting pins or other metal pieces, if any, in a batch or batches. The batch or batches involving such metal pieces are rejected in advance, since the metal pieces may damage the takeout device or conveyor. The batches P passed through the metal piece detector 13C are bent upward or downward to squeeze individual bank notes in order to prevent defective takeout by the takeout device 2 caused by skew, superposition, etc.

The moment the bank notes are squeezed, the wrapping band Pa is cut and removed from the batch P. Thereafter, the 100 untied bank notes are fed to the takeout device 2. Then, the takeout device 2 takes out the bank notes one by one. In doing this, the takeout device 2 is prevented from taking out the individual bank notes of a subsequent batch P before processing of a preceding batch P is completed.

Preferably, the batch feeder 1 is supplied with the bank notes is banded 100-sheet batches. However, loose bank notes (unbanded notes, such as reprocessed jammed notes) may also be supplied to the batch feeder 1. In supplying the loose notes, the cover 10F in front of the takeout device 2 is removed. By doing this, the operation mode of the bank note processing apparatus is automatically switched to a loose note feeding mode. The takeout of the loose notes is started by placing the loose notes on a backup plate under the takeout device serving also to supply and takeout batches, putting on the cover 10F, and depressing a feed start switch. If the feed start switch is depressed without putting on the cover 10F, it will not be activated. The backup plate is automatically checked for the existence of bank note(s) thereon by depressing the feed start switch. If there is any bank note or notes on the backup plate, the apparatus goes on operating in the loose note feeding mode. If there is no bank note on the backup plate, then the loose note feeding mode is automatically switched to the normal operation mode. The loose notes can naturally be fed from the batch feeding stand 11 if they are previously half-wrapped or banded by the operator.

Directly after the bank notes are taken out, the inspection section 2D inspects the bank notes for skew, superposition and damage. Those notes which are found to be skewed, superposed or damaged as a result of the inspection are collected as unmachinable notes P3 in the unmachinable note collecting box BIN2 without being delivered to the judgment unit 4 for denomination detection, fit/unfit detection, etc. All the bank notes other than the unmachinable notes P3 are passed through the judgment unit 4, and are collected in the counterfeit note collecting box BIN1, the different sheet collecting box BIN3, the fine note collecting box BIN4, the correct note collecting box BIN5, and the unfit note collecting box BIN6, depending on the results of judgment.

The collecting boxes BIN3 to BIN6 are in the form of individual modules which can be increased or decreased in number. For example, the different sheet collecting box BIN3 may be eliminated to reduce the size of the apparatus by collecting the different sheets and counterfeit notes together. Alternatively, a collecting box for special application may be added to the modular structure. If there is an automated teller machine (ATM) which is liable to be jammed by ordinary correct notes, it may, for example, be provided with the fine note collecting section 5C for collecting only relatively fine, jam-free notes among other correct notes, or an additional collecting section for collecting only former notes out of a mixture of newly introduced notes and the former notes, or a collecting section for collecting only dog-eared notes to be straightened for reprocessing.

If the bank note processing apparatus jams or experiences other trouble while processing a batch of bank notes, the accuracy of batch counting can not be maintained. In this case, therefore, the bank notes must be removed from the collecting boxes or conveyor path for reprocessing. Accordingly, the different sheet collecting box BIN3 and the fine note collecting box BIN4 are each provided with batch dividing means which can discriminate between individual batches so that the notes to be reprocessed are identified and minimized in number. The batch dividing means may be used as a 100-sheet divider if the bank notes need be divided by hundreds.

Jammed and crumpled notes cannot be resupplied to the apparatus until they are smoothed by hand. For higher processing efficiency, a jammed batch is not resupplied directly after it is removed from the apparatus, and another batch is fed ahead of it. After the crumpled notes are smoothed, the removed batch is fed again into the apparatus. In this case, those notes which remain in the takeout section at the time of jamming are naturally resupplied. At the point of time when the jam is caused, however, the unmachinable note(s) P3 and counterfeit note(s) P4 in the collecting boxes BIN2 and BIN1, along with a classification card and a wrapping band, are put into the cassette CST as if processing of a batch were completed.

The magnetic disk of the control unit stores data on jams and the existence of bank notes to be resupplied. When the jammed batch is resupplied, unmachinable note(s) P3 and/or counterfeit note(s) P4 involved therein are collected together with a classification card CAD in the cassette CST, as usual. Hereupon, the batch number of the identification number on the classification card CAD used for a jammed batch is automatically used for the resupplied batch. Accordingly, at the time of later cassette processing, both the jammed and resupplied batches can simultaneously be examined, by displaying the batch number or classification card number for the jammed batch on the CRT. Thus, band information can be keyed in for a count check or counterfeit note processing.

The correct notes or unfit notes are sorted by the sorter/collector 5 when they reach 100 in number, and are then half-wrapped or banded into a batch by the batch half-wrapping device 6. At the same time, the date of processing, operator's name and other particulars are put on the batch. A predetermined number of banded batches, e.g., 10 batches, are collected and half-wrapped into a bundle by the bundle half-wrapping device 7A. The aforesaid particulars are also put on the bundle. The bundle is packaged by the bundle packaging device 7B, and is discharged onto the conveyor to be transferred thereby to a predetermined position.

Two or more of such bundle packaging devices 7B may be connected at the back of the conveyor.

Besides the batch half-wrapping section 6D, destroying devices or shredders 8A and 8B are provided at the counterfeit note collecting section 5E. Thus, 100 bank notes sorted and collected in the counterfeit note collecting section 5E may be either half-wrapped by the half-wrapping device 6 or delivered to the shredders, depending on the designated operation mode. The bank notes or sheets processed by the shredders 8A and 8B are pulverized and pneumatically discharged to some external place. Exhaust gas from a pneumatic system for cooling the apparatus may be utilized for the pneumatic discharge. To reduce to noise produced by the pneumatic feed of the pieces cut by the shredders and the pulverization process, a spiral rotating member may be used for feeding the pieces.

The operating panel section 10 is provided with switches for operating the apparatus, a ten-key unit for inputting an operator's identification number, and a CRT display for indicating the operating conditions of the apparatus, operating instructions, location of jam, etc. The operating panel section 10 is separated from the mechanical section by partition walls. All the devices or units other than the operating panel section 10 and the batch feeding stand 11 are located inside the partition walls. Accordingly, the noise heard by the operator can be reduced. If you open a door to enter the space inside the partition walls, then a monitoring device will be actuated automatically. Thus, the state of the internal space may be monitored, to improve the security of the apparatus.

Now the processing operation related to the cassettes CST in the rejected note collecting section 5A will be described as follows. The magnetic disk of the control unit stores all data on the results of counting and detection for each batch of bank notes, such as the numbers of correct notes, unfit notes, unmachinable notes, and counterfeit notes. For the unmachinable notes, the magnetic disk further stores the result of detection or the cause of rejection, such as superposition, skew or short pitch, for each individual note in each batch. For the counterfeit notes, the magnetic disk stores the result of detection, such as wrong pattern or absence of magnetism, water-marks, security thread or fluorescence, for each note. The stored data is matched to the identification number of the classification card.

At least two cassettes CST are set in the bank note processing apparatus. One of the cassettes is for normal use, while the other cassette(s) is are additionally used when the first cassette is full or is removed for any reason. In processing the notes in one cassette while the apparatus is in operation, a cassette processing button is depressed to turn on a lamp corresponding to the cassette in service. At this moment, the scene of processing is automatically shifted to the other cassette, so that the first cassette is allowed to be removed. When an apparatus processing stop button is depresed, a lamp corresponding to the cassette having been used so far glows, indicating that the cassette is ready to be removed. The lamp is put out by depressing an apparatus processing button.

When the cassette is full, the lamp corresponding to this cassette glows. Then, the scene of processing is shifted to the other cassette, and the first cassette is allowed to be removed. If the cassette is not removed after a predetermined number of bank notes are processed after the cassette processing button is depressed or after the cassette is filled, then the lamp flickers to urge the operator to remove the cassette. If the cassette is not removed even after that, the lamp corresponding to the currently used cassette glows after a predetermined number of additional bank notes are processed. This is a final alarm. In this case, both lamps are put out by removing the cassette corresponding to the flickering lamp and setting in an empty cassette.

If the empty cassette is not installed after the final alarm or the removal of the first cassette, the lamp flickers and the apparatus processing is stopped, when the cassette is full. When the lamp is on or flickering, an alarm may be given to accelerate the cassette processing. The bank notes in the removed cassette are counted and manually judged by another operator at an independent cassette processing table, which operation is different from the apparatus operator. The removed cassette is processed by the external operating device 100.

The external operating device 100 is provided with a keyboard 100E for inputting the identification number of a classification card and the number of bank notes, a CRT 100C for indicating processing data on the batch corresponding to the classification card number, and a printer 100D for printing out the processing data on each batch indicated on the CRT, as required, all of these units 100E, 100C, 100D being on-line connected to the bank note processing apparatus.

Figure 18:
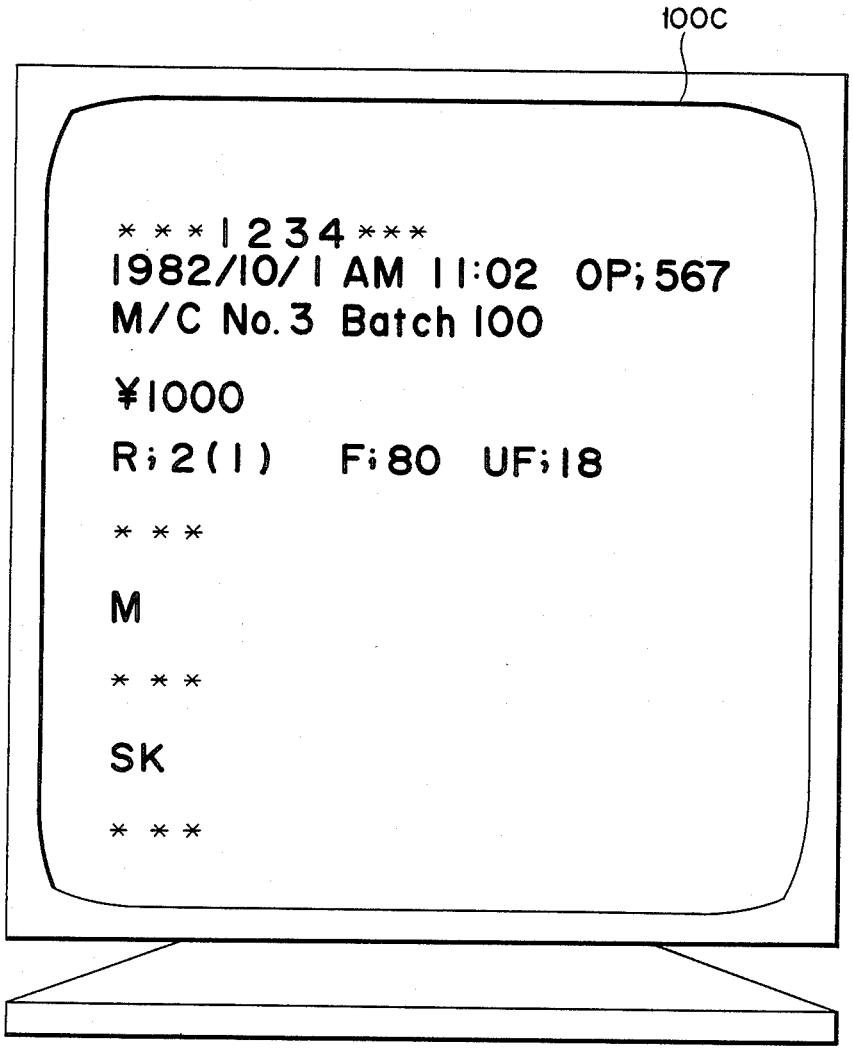
FIG. 18 is a front view showing an example of an indication mode on a CRT of an external operating device.

In processing the cassette CRT, the cassette is first uncovered and the identification number of the uppermost classification card CAD is keyed in. Count data and detection data corresponding to the identification number of the classification card CAD are indicated on the CRT 100C. FIG. 18 shows an example of a data indication mode, which contains the identification number of classification card, 1234, date, 1982/10/1, time, AM 11:02, operator's number, OP;567, apparatus number, M/C No. 3, total number of batches processed after power is turned on, 100, denomination, 1,000, number of rejected notes R, 2 (counterfeit note, 1), number of correct notes F, 80, and number of unfit notes UF, 18. "M" indicates absence of magnetism as the cause of rejection of the counterfeit note out of the two rejected notes, while "SK" indicates skew as the cause of rejection of the unmachinable note. If there are a plurality of rejected notes, data is successively indicated on the CRT in such a manner that data on the note fed last is indicated first. Thus, each rejected note may be matched to the indication on the CRT. The number of rejected notes R, 2 is obtained by subtracting the sum of the number of legitimate notes F, 80 and the number of unfit notes UF, 18 from the total number of bank notes contained in one batch, i.e., by subtracting this sum from 100. Thus, the cassette is actually checked for the number of rejected notes therein. If two rejected notes are detected, a clear button on the keyboard 100E is depressed to discard the band on the unmachinable notes P3, and the rejected notes are stored in a reprocessing box.

When the 100th. bath is collated at this point of time, the CRT 100C automatically displays data on the next, or the 99th batch. The data on the 100th batch are indicated first because the bank notes in the cassette are taken out in the order reverse to the order of collection. Accordingly, in starting the processing with the first batch, by turning the cassette upside down, the CRT 100C must be rearranged for the corresponding order of indication.

If the actual number of rejected notes differs from the indicated number, the code number of a half-wrapper's name, which appears on the wrapping band of the unmachinable note, is keyed in; a mark "R" representing the rejected note and the correct number are keyed in after the code number; and the clear button is depressed twice. If the actual number of counterfeit notes is different from the indicated number, a band code number is keyed in, and a mark "C" representing the counterfeit note and the correct number are keyed in after the code number. If the actual number of both rejected notes and counterfeit notes detected by manual counting differ from the numbers indicatd on the CRT, code "R2C1" is keyed in for the two rejected notes, including one counterfeit note, after the band code number is keyed in, and the clear button is then depressed twice. Counterfeit notes, along with bands, are stored separately from unmachinable notes, for ease of later rejudgment. The CRT indication for the counterfeit notes may be made prominent by the use of a bright color (e.g., red), which color difers from those used for other indications.

The identification numbers of individual classification cards are automatically indicated in due order on the CRT, by merely keying in the number for the uppermost classification card. The external operating device 100 can be coupled to a plurality of apparatuses. All data, including the count number and the results of detection for each batch, may be stored in the classification cards, so that the collation of counting and data correction can be executed as a card reader reads the classification card, after the rejecting operation. Thus, on-line processing is permitted.

What is claimed is:

1. An apparatus for processing paper sheets for general use, said sheets being stored in batches sealed with a wrapping band, comprising:

carrying means for carrying said withdrawn paper sheets;

wrapping band removal means for cutting said wrapping band;

pickup means for picking up said paper sheets from said carrying means, one by one;

inspection means for inspecting said paper sheets picked up by said pickup means, and for classifying said paper sheets into two groups, an unmachinable first group and a machinable second group;

first collecting means for collecting said first group of paper sheets;

judgment means for classifying said second group of paper sheets into two subgroups, a legitimate third group and a counterfeit fourth group;

second collecting means for collecting said third group of paper sheets;

third collecting means for collecting said fourth group of paper sheets, said third collecting means including: a) a housing which is open at the bottom, b) a bottom plate attached to said housing in such a way that said bottom plate can be moved, and c) driving means for moving said bottom plate;

means for supplying a classification card to said third collecting means;

wherein said first collecting means includes a receiving surface disposed under said bottom plate of said third collecting means, so that said fourth group of sheets and said classification card can be placed onto said receiving surface;

storage means, disposed under said first collecting means, to receive: (1) said first group of paper sheets, (2) said wrapping band, (3) said fourth group of paper sheets, and (4) said classification card; and extrusion means for collectively pushing out, into said storage means, said first group of paper sheets collected on said receiving surface, said wrapping band, and said fourth group of paper sheets.

2. The apparatus according to claim 1, wherein, each of said batches consists of a predetermined number of paper sheets;

and said apparatus further comprises said supplying means adjoining said third collecting means and adapted to issue said classification card which bears the identification number of the batch of paper sheets when the processing of said batch of paper sheets is completed.

3. The apparatus according to claim 2, wherein control means including memory means stores an identification number of a batch concerned when said classification card is issued by said card issuing means.

4. The apparatus according to claim 2, wherein said paper sheets of said fourth group are piled up, one after another, in accordance with a processing sequence; and control means including memory means stores said results of inspection and judgment in accordance with said processing sequence, reading out said results in accordance with a sequence opposite to said processing sequence.

5. The apparatus according to claim 1, wherein said wrapping band removal means delivers said cut wrapping band to said third collecting means before inspection by the inspection means.

6. An apparatus for processing paper sheets for general use, said sheets being withdrawn as required and being classified into two categories, those fit for reuse and those unfit for reuse, comprising:

means for carrying batches of paper sheets, each said batch of paper sheets being sealed with a wrapping band, said carrying means including wrapping band removal means for removing said wrapping band on said paper sheets;

pickup means for picking up said paper sheets from said carrying means, one by one;

judgment means for classifying said paper sheets picked up by said pickup means into a legitimate group and a counterfeit group, and for judging types of counterfeitness among the respective counterfeit paper sheets;

means for collecting said counterfeit of paper sheets;

storage means for storing a plurality of classification cards, which have respective identification numbers prepared thereupon, in a pile; and supply means disposed near the collecting means for feeding, one by one each classification card to said collecting means.

7. The apparatus according to claim 6, which further includes:

memory means for storing information representing said types of counterfeitness among the respective counterfeit paper sheets in each batch; and display means for simultaneously displaying (1) an identification number indicative of a classification card in a particular batch, and (2) type of counterfeitness among each group of paper sheets in said particular batch.

8. The apparatus according to claim 6, wherein said collecting means includes counterfeit paper sheet collector means for receiving said classification card, and for placing such classification card on an uppermost counterfeit paper sheet for each batch.

9. The apparatus according to claim 8, which further includes cassette means, provided under said collector means, and transfer means for transferring at least one of the counterfeit paper sheet and classification card for each batch, whereby a plurality of batches with said classification card placed on the uppermost counterfeit paper sheet in each batch are stored in said cassette means.

10. An apparatus as in claim 6 wherein said supplying means is also for inserting a classification card between adjacent batches in said collecting means to thereby distinguish said batches from one another.

11. An apparatus as in claim 6, wherein said storage means includes a card magazine in which the classification cards are piled vertically and said supplying means includes a takeout roller disposed under the card magazine to contact with a lowermost classification card and being rotatable to take out the lowermost classification card.

12. An apparatus as in claim 6, wherein said identification number is particular to a particular batch of paper sheets.

13. An apparatus as in claim 12 further comprising control means including means for storing information about said classification cards.

* * * * *